US006752349B2

(12) United States Patent
Moody et al.

(10) Patent No.: US 6,752,349 B2
(45) Date of Patent: Jun. 22, 2004

(54) SUPPORT SLED FOR ROLLS OF ABSORBENT SHEET AND DISPENSER INCORPORATING SAME

(75) Inventors: John R. Moody, Neenah, WI (US); Gregory D. Budz, Sobieski, WI (US); Michael R. Kilgore, Little Suamico, WI (US)

(73) Assignee: Fort James Corporation, Atlanta, GA (US)

( * ) Notice: Subject to any disclaimer, the term of this patent is extended or adjusted under 35 U.S.C. 154(b) by 0 days.

(21) Appl. No.: 10/322,327

(22) Filed: Dec. 18, 2002

(65) Prior Publication Data

US 2003/0146337 A1 Aug. 7, 2003

Related U.S. Application Data

(60) Provisional application No. 60/342,944, filed on Dec. 20, 2001.

(51) Int. Cl.[7] ..... B65H 19/00

(52) U.S. Cl. ..... 242/560; 242/599.3

(58) Field of Search ..... 242/560, 560.2, 242/598.1, 598.4, 599.3, 594

(56) References Cited

U.S. PATENT DOCUMENTS

| | | | | | |
|---|---|---|---|---|---|
| 1,919,456 | A | * | 7/1933 | Wolf | 242/594 |
| 2,549,912 | A | * | 4/1951 | Lindsay | 242/598.4 |
| 3,214,014 | A | | 10/1965 | Perrin | 206/58 |
| 3,294,329 | A | | 12/1966 | Tucker et al. | |
| 3,381,909 | A | | 5/1968 | Tucker et al. | |
| 3,387,902 | A | | 6/1968 | Perrin et al. | 312/39 |
| D212,010 | S | | 8/1968 | Tucker | D33/31 |
| 3,948,454 | A | | 4/1976 | Bastian | |
| 4,143,827 | A | | 3/1979 | Tucker | |
| 4,375,874 | A | | 3/1983 | Leotta et al. | |
| 4,662,577 | A | | 5/1987 | Lewis | |
| 5,370,336 | A | | 12/1994 | Whittington | 242/560.2 |
| D386,025 | S | | 11/1997 | Mervar et al. | D6/520 |
| 5,690,299 | A | * | 11/1997 | Perrin et al. | 242/560 |
| 5,873,542 | A | * | 2/1999 | Perrin et al. | 242/560 |
| 6,138,939 | A | * | 10/2000 | Phelps et al. | 242/599.3 |

* cited by examiner

*Primary Examiner*—William A. Rivera
(74) *Attorney, Agent, or Firm*—Michael W. Ferrell

(57) ABSTRACT

A roll support sled is adapted to support a plurality of rolls of absorbent sheet, such as rolls of coreless tissue for mounting in a dispenser of the class including a pair of vertically oriented guide tracks for guiding the roll support sled in vertical motion for sequential dispensing of the rolls. At least one of the guide tracks of the dispenser defines a locking shoulder and the roll support sled includes: first and second spindles, first and second frame rails, one of which is movable, as well as a novel latch dog assembly. The latch dog assembly is inwardly biased and disposed adjacent at least one of the spindles. The latch dog is configured so that it is urged outwardly to a locking position upon disposing a roll of absorbent sheet about its adjacent spindle and is biased inwardly to a release position upon depletion of the roll of absorbent sheet material disposed about its adjacent spindle. In a preferred embodiment the latch dog assembly includes a pivotally mounted gauge member adapted to engage the end of a roll of absorbent sheet material positioned about its adjacent spindle whereby the gauge member is urged outwardly into generally parallel alignment with a frame rail of the support sled upon contact with the roll of absorbent sheet material. When contacted by a full roll, the latch dog assembly is urged outwardly to its locking position. Upon depletion of the roll of absorbent sheet material disposed on the spindle, the latch dog assembly pivots inwardly so that it assumes its release position. The support sled then drops vertically, for instance, under the influence of gravity to expose a reserve roll of absorbent sheet material for dispensing.

39 Claims, 10 Drawing Sheets

SUPPORT SLED FOR ROLLS OF ABSORBENT SHEET AND DISPENSER INCORPORATING SAME

CLAIM FOR PRIORITY

This non-provisional application claims the benefit of the filing date of U.S. Provisional Patent Application Serial No. 60/342,944, of the same title, filed Dec. 20, 2001 now expired.

TECHNICAL FIELD

The present invention relates generally to dispensers for sequentially dispensing rolls of tissue, towel, or the like of the general class used for commercial operations and institutions. In a preferred embodiment, the present invention is directed to a dispenser for sequentially dispensing coreless rolls of tissue utilizing a support sled mounted for generally vertical motion within the dispenser.

BACKGROUND

Absorbent sheet is frequently distributed in the form of a roll of strip material. There is disclosed in U.S. Pat. No. 3,214,014 to Perrin a roll of strip material having a separable core structure. It is well known that the winding of rolls of strip material such as paper toweling, bath tissue, or the like, may entail the utilization of a hollow, elongated cylindrical core which is customarily fabricated from cardboard or similar material. The rolls of strip material incorporating such cores may be supported by the location of bearing bosses in the opposite extremities of the core, the bearing bosses being adapted to permit rotation of the roll of strip material in order that lengths of strip material may be dispensed from the roll. When the roll of strip material is consumed, difficulty may be encountered in dislodging the cores from the associated bearing bosses. This is particularly true in the case of public washrooms where the attendants must mount and dismount large numbers of rolls of tissue and towel and the time consumed in mounting and dismounting rolls is greatly increased by the difficulties inherent in the mounting and dismounting of the core structures. In accordance with the aforesaid U.S. Pat. No. 3,214,014 there is provided a core structure constituted by a pair of core elements each of which is a cylindrical body which may be formed of cardboard, plastic or the like and which are disposed in end to end relationship. Alternatively, the elements of the core could be semi-cylindrical and disposed in face to face relationship. The so-called "split core" product disclosed in the '014 patent has the advantage that the strip material holds the core together, such that when the strip material is exhausted the core is readily disassembled into its component parts and removed from the dispenser. The split core material has thus enjoyed significant commercial success particularly for commercial operations and institutional use.

Likewise, it is desirable to have dispensers that dispense more than one roll of material in a sequential manner. For instance, this type of arrangement would allow an attendant to replace material much less frequently than would be the case for single roll dispensers. In connection with such dispensers, it is further noted that it is highly desirable for one roll of material to be exposed for use until that exposed roll is exhausted and a second roll is held in a reserved or covered position, until such time as the first roll is exhausted. In this connection there is disclosed in U.S. Pat. No. 3,381,909 to Tucker et al. an apparatus for sequentially dispensing rolls of strip material. In the '909 patent there is shown a dispenser having two mandrels or spindles for receiving rolls of strip material fulcrummed about a central point. Upon installation a first roll is in a lower position and, upon exhaustion thereof, the spring biased mounting lever pivots about a center point whereby the mounting mandrel of the exhausted roll moves upwardly and a new or fresh roll moves downwardly into a dispensing position. Separable cylindrical mounts cooperate with the split roll material to activate the transition of the second roll to a dispensing position.

So also, there is disclosed in U.S. Pat. No. 3,294,329 to Tucker et al. another dispenser for sequentially dispensing rolls of strip material. In accordance with the '329 patent there is provided a dispenser which may be readily refilled prior to the complete exhaustion of both rolls of tissue being dispensed therefrom. That is to say, it is not necessary to remove a partially exhausted roll in order that a full roll may be placed in the dispenser but merely necessary that a full roll can be placed in the reserve position while a partially consumed roll being dispensed is maintained in the dispensing position. In the device according to the '329 patent there is provided sensor or detector means constituted by elongated detector arms pivotally mounted upon a common pivot pin for independent rotation with respect to the roll holder. Each of the sensor or detector arms is urged downwardly about the circumference of an associated roll by a torsion spring secured by a pivot pin. The sensor arms are coupled to latch dogs which engage a centrally located rib to hold the rolls of material in position. When a first roll is exhausted, the sensing arms activate the latch dogs so as to rotate the roll support frame so that a new roll is presented for dispensing.

Still another dispenser for sequentially dispensing rolls of tissue and the like is disclosed in U.S. Pat. No. 3,387,902 to Perrin et al. Unlike the patents discussed above, the '902 patent is directed to a dispenser designed to hold two rolls on a sled or frame, generally in a vertical relationship wherein the lower roll is presented for dispensing and the upper roll lies generally under a cover in a first, or fully loaded position. There is further provided latch means for retaining the roll holder assembly in this first position which are releasable for permitting vertical movement of the roll holder assembly to a second position. The latch means are associated directly with a roll split core detection mechanism. The reported advantages according to the '902 patent are that the split core geometry is utilized to minimize moving parts so that complicated and interconnecting arms and levers are not required. With the first, or lowermost roll of tissue in the dispensing position and the second or uppermost roll of tissue in the reserve or non-dispensing position, the first roll of tissue may be used in conventional manner and upon complete use of the wrapped tissue, the split cores are exposed and a housing latch spring bearing transversely against a sleeve latch engagement leg engaged with a housing latch stop will overcome the lessor resilient force of a holder spring of the roll holder, thereby pivoting the roll holder sleeve relative to the roll holder mandrel. The pivoting of the sleeve of the roll holder, by way of the housing latch spring, forces the sleeve latch engagement leg transversely off of a housing latch stop or shoulder freeing the roll holder assembly for further movement downward along the housing tracks. See also U.S. Pat. No. 4,143,827 to Tucker which shows a roll holder of the type disclosed in the aforesaid '902 patent for mounting split core rolls of tissue. The roll holder of the '827 patent is positioned in a dispenser moveable from an upper dispensing position to a lower exhausted position. The device includes blocking members at roll holder opposite ends normally retained inactive permitting a release operation in the presence of split core material but automatically moving to a position preventing proper operation upon lack of a split core product. This dispenser insures that the split core product must be utilized for proper roll holder functioning and that a solid core roll cannot be used with core stripping to cause the roll holder functioning. In any case, it is noted that avoiding core stripping from the roll can reduce undesirable littering.

While split core products have provided advantages in terms of ease of filling and replenishing dispensers, coreless products provide more useful material per roll, such that less storage space for shipping and dispensing is required for a given amount of product and there is no need to have expensive and wasteful cores which are discarded when the material is exhausted. There is shown in U.S. Pat. No. 5,370,336 to Whittington a dispenser for sequentially dispensing webbed material from a plurality of coreless rolls including a support sled mounted in a housing having a dispensing opening. The coreless roll holder support sled is slideably positioned in channels or tracks formed in the support and includes a frame and coreless roll support spindles connected to the frame at spaced locations. Each coreless roll support shaft is for insertion into a central aperture of a coreless roll. The coreless roll holder moves between alternate locations relative to the housing to provide selective manual access to the coreless rolls for dispensing. A lock retains the coreless roll holder in one of the locations until a coreless roll is depleted from one of the coreless roll support shafts and the coreless roll holder will automatically move to the second location under the influence of gravity. The coreless rolls are slid over the coreless roll support shafts which results in inward displacement of mandrels associated with the shafts and the consequent movement of a locking element to a locking position relative to the support assembly. When the lower tissue roll becomes substantially depleted, the mandrel underneath it will flex outwardly and the lock element will be withdrawn, allowing the roll support to slide downwardly and expose the second roll. The mandrels associated with the shafts include a plurality of detents and flanges to activate the locking mechanism.

It is an object of the present invention to provide a simpler, more economical and reliable support sled for sequential dispensers of the general type disclosed in the aforesaid '336, '827 and '902 patents.

The overall appearance of dispensers in accordance with the present invention is typically such that there is provided an upper cover to sequester a reserve roll and a lower opening to present product to a user. Such designs may be seen for example in U.S. Pat. No. DES. 212,010 to Tucker. Another preferred design is seen in U.S. Pat. No. DES. 386,025 to Merver et al.

The disclosure of the foregoing patents is incorporated herein by reference.

SUMMARY OF INVENTION

A roll support sled adapted to support a plurality of rolls of absorbent sheet material, for example, coreless tissue for mounting in a dispenser is provided in accordance with the present invention. Typically, the roll support sled is mounted in a dispenser of the class including a pair of vertically oriented guide tracks for guiding the support sled in generally vertical motion for sequential dispensing of the rolls. At least one of the tracks includes latch means defining a locking shoulder. The roll support sled includes generally: (a) first and second spindles for receiving rolls of the absorbent sheet material; (b) first and second frame rails for supporting the first and second spindles, the rails being provided with guide means configured to cooperate with the guide tracks of the dispenser in which the support sled is mounted for guiding the support sled in generally vertical motion between an upper dispensing position and a lower dispensing position.

At least one of the frame rails is moveable with respect to the first and second spindles of the support sled and includes a first and a second retaining flange configured to releasably secure rolls of absorbent sheet about the first and second spindles of the support sled in a retaining position. The moveable frame rail is also moveable to an open position so as to allow the positioning of fresh rolls of absorbent sheet material about the first and second spindles.

At least one of the frame rails is provided with an inwardly biased latch dog assembly disposed adjacent at least one of the first and second spindles. The latch dog assembly is configured and mounted so that it is urged outwardly to a locking position upon disposing a roll of absorbent sheet material about its adjacent spindle and is biased inwardly to a release position upon depletion of the roll of absorbent sheet material disposed about its adjacent spindle. The latch dog assembly of the support sled is adapted to cooperate with the locking shoulder of the guide track of the dispenser to retain the support sled in the upper dispensing position while urged outwardly to its locking position. The sled is likewise configured and mounted to allow movement of the support sled to the lower dispensing position upon movement of the latch dog assembly to its inner release position. In this way the upper or reserve roll of absorbent sheet material is positioned for dispensing as will become apparent from the discussion and drawings which follow.

BRIEF DESCRIPTION OF DRAWINGS

The invention is described in detail below with reference to the various figures wherein like numerals designate like parts and wherein.

DETAILED DESCRIPTION

Figure 1:
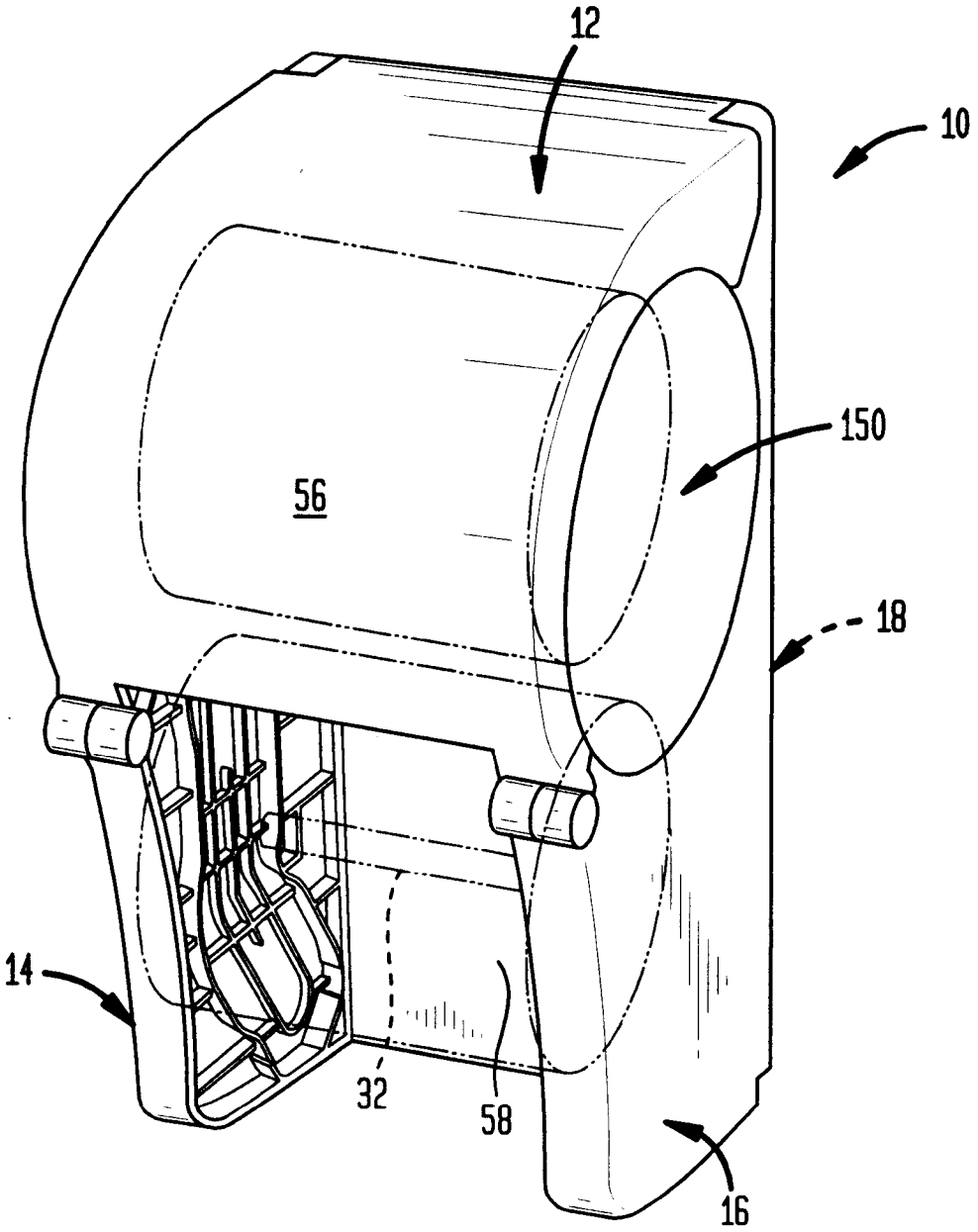
FIG. 1 is a perspective view, partially in phantom lines showing a dispenser for absorbent sheet configured in accordance with the present invention wherein the roll support sled of the dispenser is positioned in its upper dispensing position and provided with 2 rolls of tissue.
Figure 2:
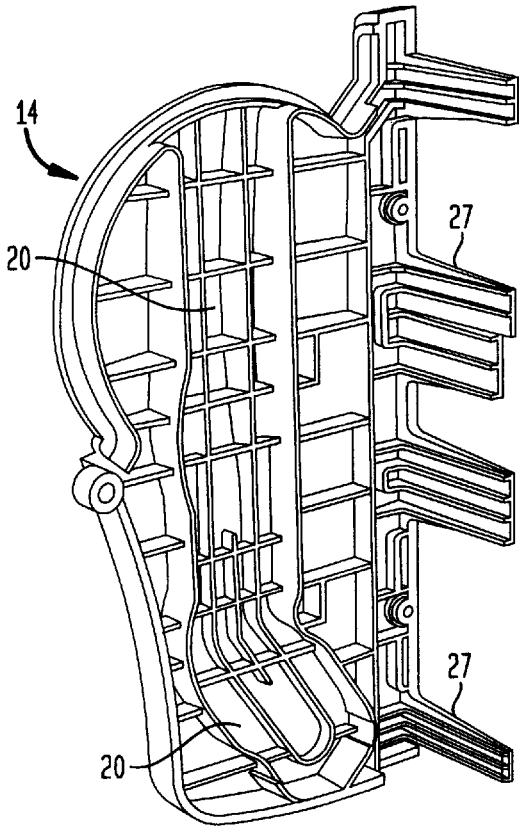
FIG. 2 is a perspective view showing the left inside sidewall of the dispenser of FIG. 1.
Figure 3:
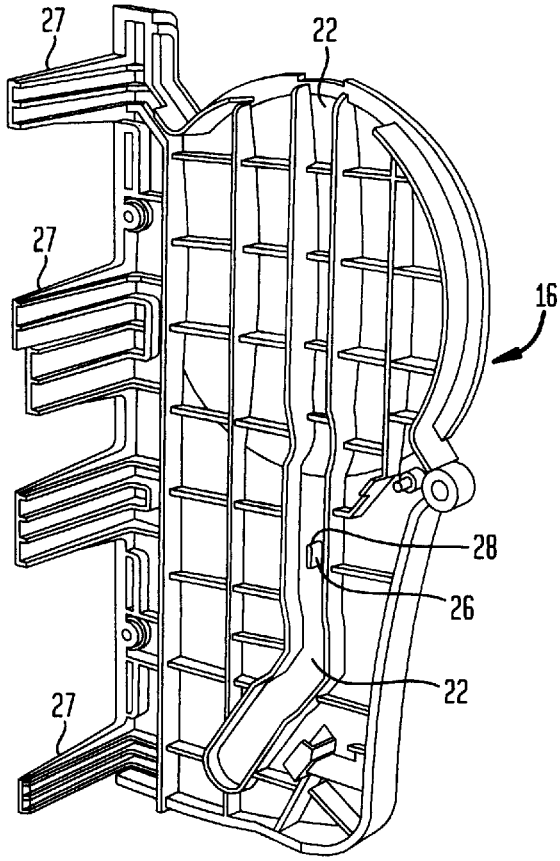
FIG. 3 is a perspective view showing the inside of the right sidewall of the dispenser of FIG. 1.
Figure 4:
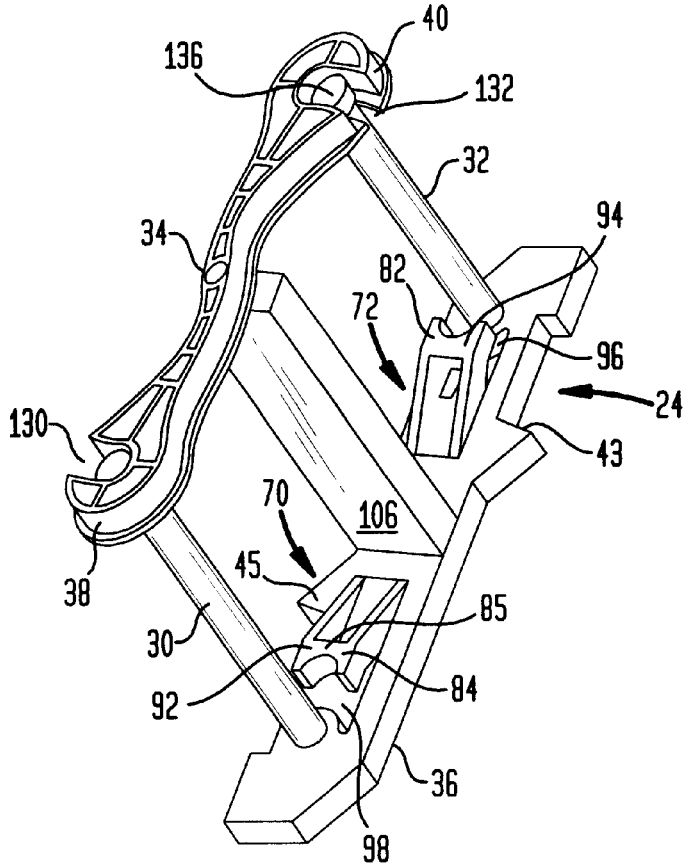
FIG. 4 is a view in perspective showing the roll support sled of the dispenser of FIG. 1.
Figure 5:
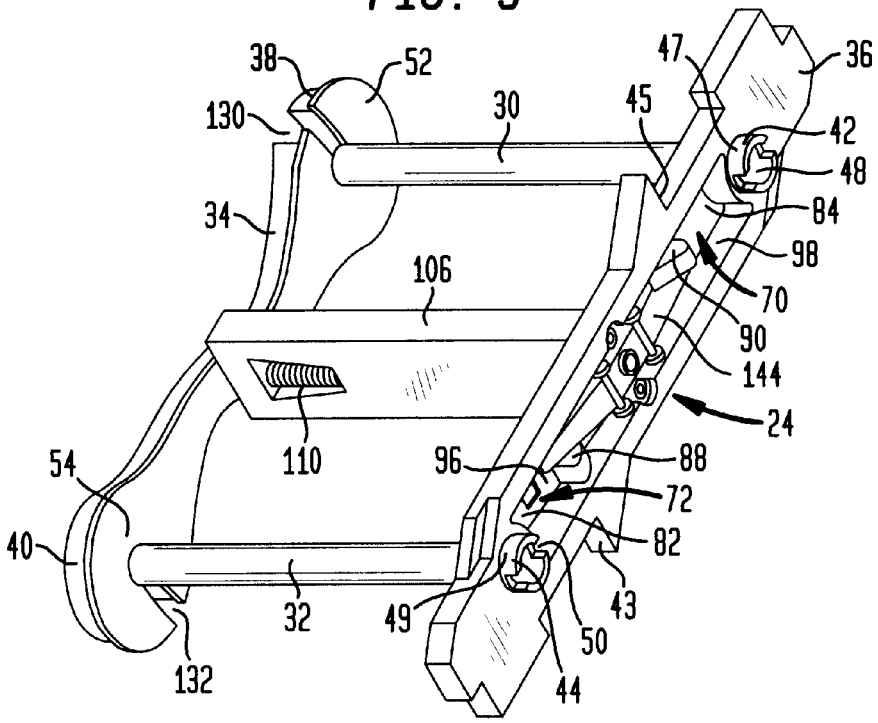
FIG. 5 is another view in perspective showing the roll support sled of the dispenser of FIG. 1.

The invention is described in detail below with reference to the various figures. Such discussion is for purposes of illustration only and is not intended to be limitative of the invention in any way. Modifications to the embodiment described hereinafter within the spirit and scope of the present invention, set forth in the appended claims, will be readily apparent to those of skill in the art.

Referring to the various figures there is shown a tissue roll dispenser 10 including a cover 12, a left sidewall 14, a right sidewall 16, as well as a backwall 18. The left sidewall has a guide track 20 whereas right sidewall 16 has a guide track 22. The guide tracks are used to mount a support sled 24 configured to hold rolls of strip material as will be discussed in more detail hereinafter. Guide track 22 of right sidewall 16 includes a latch projection 26 provided with a locking shoulder 28. The dispenser is typically formed of plastic and the sidewalls can be provided with a plurality of tabs 27 to fit into slots in backwall 18 in order to assemble the dispenser. Preferably the sidewalls are provided with a ribbed construction as shown to conserve material while providing rigidity.

Sled 24 includes a first spindle 30, a second spindle 32, a left frame rail 34 and a right frame rail 36. The left frame rail has generally circular guide surfaces 38 and 40 configured to cooperate with guide track 20 of left sidewall 14 to guide support sled 24 in generally vertical motion within dispenser 10. Likewise, right frame rail 36 has generally circular guide surfaces 42 and 44 configured to cooperate with guide track 22 of right sidewall 16 to guide support sled 24 in generally vertical motion within the dispenser. Guide surfaces 42 and 44 may be provided by way of tracking posts 47,49 with slots 48 and 50 so that the support sled will bypass locking shoulder 28 of latch projection 26 as it moves along the track. The right frame rail is optionally provided with anti-reversing shoulders 43,45 to prevent unwanted motion of the sled within the dispenser as is known.

Left frame rail 34 is provided with a pair of retaining flanges, 52,54 which are used to hold a first coreless tissue roll 56 and a second coreless tissue roll 58 about first spindle 30 and second spindle 32 respectively.

Coreless tissue rolls generally have a relatively small central aperture 57 which may have a diameter of about ¾ of an inch or so configured to fit around the spindles of sled 24. Preferably, the aperture has a diameter of about ⅝" or so. This type of tissue roll does not require any independent structure such as a cardboard or plastic cylinder and is advantageous inasmuch as more material can be placed on one roll and this method of dispensing tissue eliminates the wasteful core.

Figure 6:
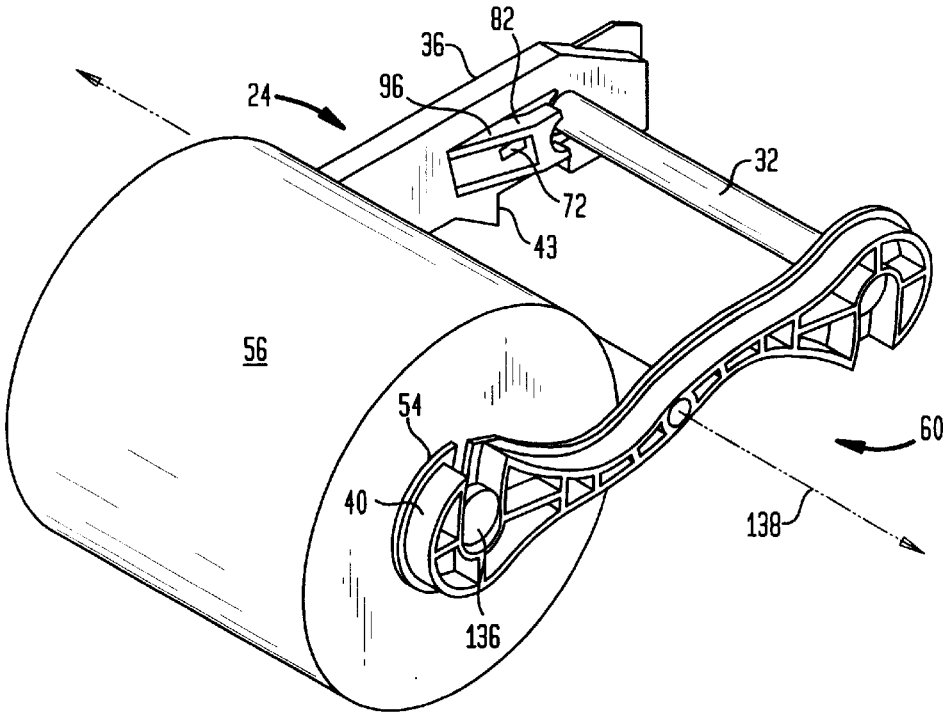
FIG. 6 is a view in perspective showing a roll of absorbent sheet material mounted on the roll support sled of the dispenser of FIGS. 1–5.
Figure 7:
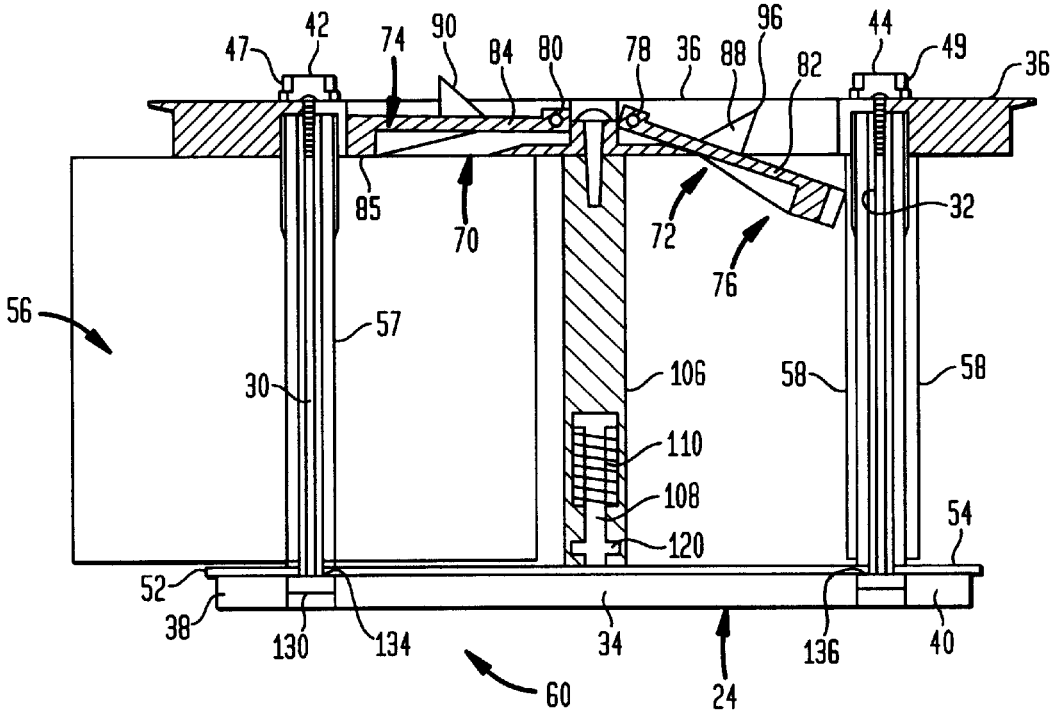
FIG. 7 is a schematic top plan view of the support sled showing a roll of absorbent sheet material mounted thereon and illustrating operation of the latch dog assemblies of the sled and showing the left movable frame rail in its closed position.

There is shown in FIGS. 6 and 7 left frame rail 34 in a closed or tissue retaining position wherein frame rail 34 is positioned so that its flanges secure roll 56 about spindle 30 in a retaining position 60.

Figure 10:
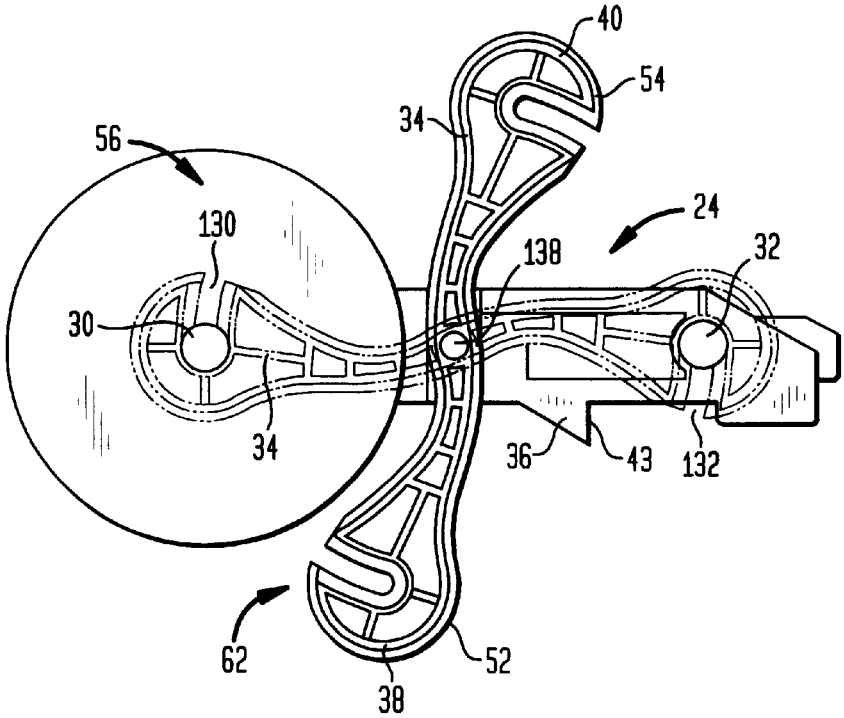
FIG. 10 is a schematic view of the roll support sled along its left side wherein one roll of tissue is mounted on the sled and the left support frame rail has been rotated to its open position.
Figure 12:
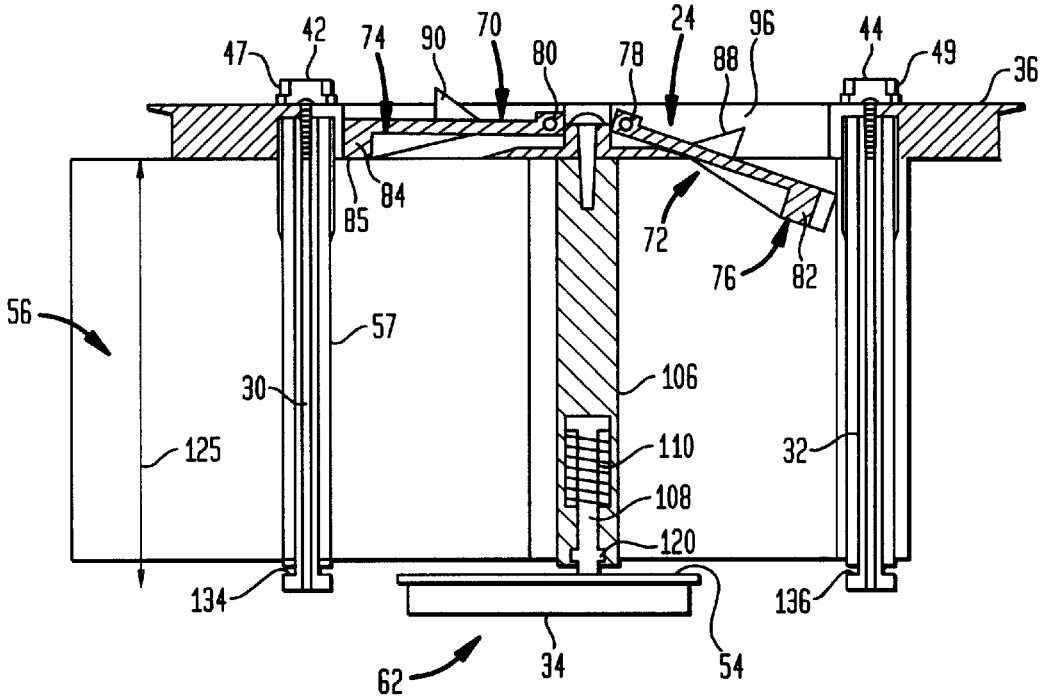
FIG. 12 is a top plan schematic view of the roll support sled wherein the rotatable support frame rail has been rotated to its open and outward position as is seen in FIG. 10.

In contrast, in FIGS. 10 and 12 there is shown frame rail 34 in its open position 62 wherein tissue rolls may be placed about spindles 30 and 32, that is to say the open position showing in FIGS. 10 and 12 is used to replenish the rolls of tissue on the sled.

Right frame rail 36 is provided with a first latch dog assembly 70 as well as a second latch dog assembly 72. It can be seen in FIG. 7, that latch dog assembly 70 assumes a locking position 74 when a roll of tissue such as roll 56 is urged against the assembly by way of retaining flange 52; that is, it is secured in place by way of retaining flange 52. On the other hand, it can also be seen in FIG. 7 that latch dog 72 assumes an inward or release position 76 when there is insufficient tissue on roll 58 about spindle 32 to urge latch dog 72 assembly outwardly as would be the case for example when a full roll of tissue is in place. That is, when the tissue is depleted the latch dog assembly assumes release position 76 because it is inwardly biased.

Figure 9:
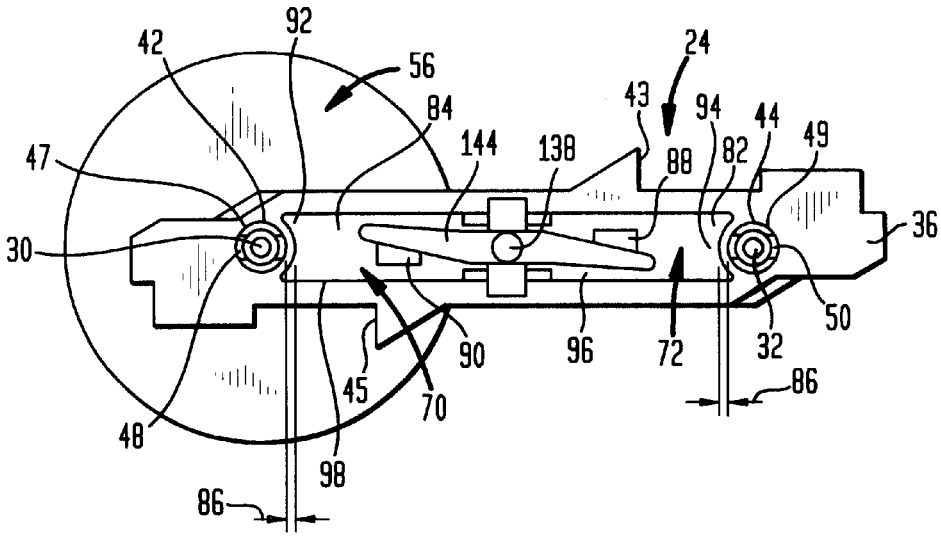
FIG. 9 is a schematic view of the support sled of the dispenser along its right side showing a roll of absorbent sheet material mounted about one spindle thereof and illustrating the various parts.

The latch dog assemblies are pivotally mounted about mounting pins 78,80 respectively and include gauge members 82 and 84. Each of the gauge members is disposed a predetermined distance 86 from its associated spindle as can be seen in FIG. 9. Preferably the gauge member includes a terminal portion such as portions 92,94 that are generally arcuate in shape such that the distance between the gauge member and its associated spindle is relatively uniform when the latch dog assembly is in the locking position. Gauge member 82 is provided with a first latch dog projection 88 whereas gauge member 84 is provided with a second latch dog projection 90. Latch dog projections 88,90 are configured as shown to cooperate with locking shoulder 28 of latch projection 26 to hold sled 24 in the upper position shown in FIG. 1 when the latch dog assemblies are in their locking position and the sled is mounted in the tracks of the dispenser.

Right frame rail 36 preferably includes a slot 96 and a slot 98 in which gauge members 82 and 84 respectively are mounted in the rail. The gauge members include a surface such as surface 85 that is generally contiguous with the inner surface of frame rail 36 when the latch dog assemblies are biased to their locking positions as is seen in FIGS. 7 and 12, left side.

Support sled 24 further includes a support bar 106 generally located between spindles 30, 32. The support bar has mounted therein a retaining pin 108 which is spring biased inwardly by way of spring 110. Retaining pin 108 further includes a cross bar 120 which cooperates with the end of support bar 106 so that left frame rail 34 travels in generally helical motion when it is rotated for replenishing the dispenser. The particular geometry of the end of support bar 106 will be appreciated by way of reference to FIGS. 11 and 12.

Figure 11:
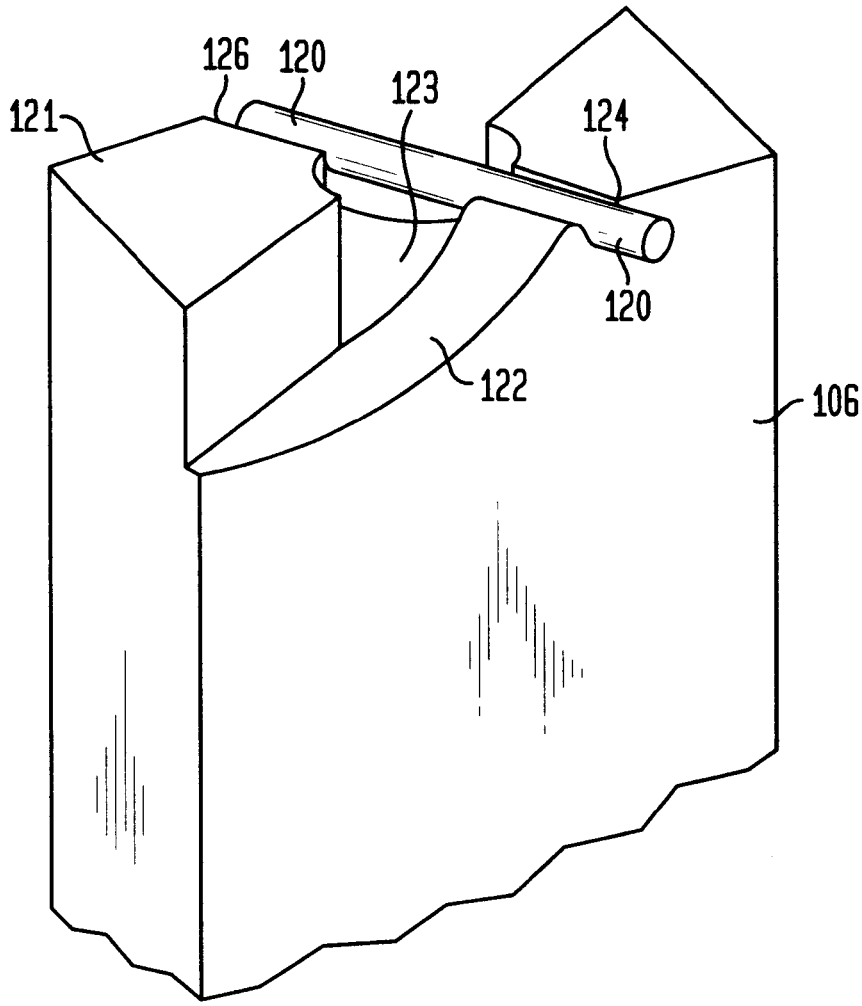
FIG. 11 is an enlarged schematic detail of the end of a support bar configured to impart a helical rotation to a support frame rail.

It can be seen from FIG. 11 that an end 121 of support bar 106 is provided with a pair of helical ramps 122 and 123 which cooperate with cross bar 120 to move it to an outer pair of slots 124, 126 upon rotation of frame rail 34 as shown in FIGS. 10 and 12. That is to say the ramp will cause rail 34 to move outwardly increasing a distance 125 between the rails when the rail is in an open position. In this way loading of the rolls onto spindles 30,32 is facilitated since the rail moved helically outwardly as shown in FIGS. 10, 11 and 12 allows clearance for the rolls.

It should be appreciated from the various Figures and especially FIG. 10 that each of the flanges 52,54 are provided with slots 130,132 so that they may be readily locked in position about the ends of spindles 30,32. To this end each of the spindles projects outwardly with respect to a roll placed thereon and includes a channel, such as channels 134 and 136 respectively of spindles 30 and 32. These channels cooperate with the slots to lock rail 34 in a closed position before support sled 24 is placed in the dispenser.

Figure 13:
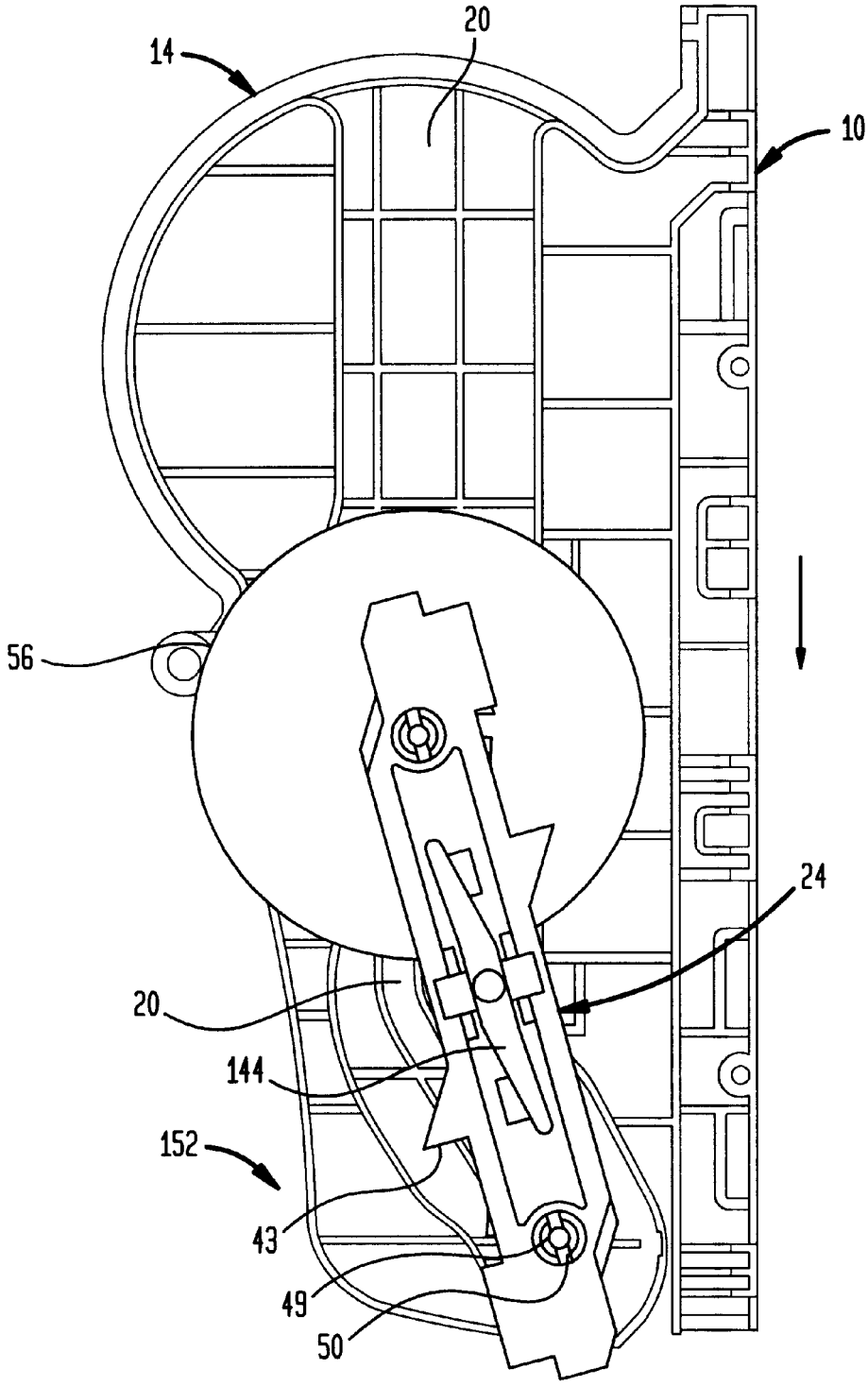
FIG. 13 is a schematic view in elevation and section of the roll dispenser of FIG. 1 wherein a lower roll has been depleted and the roll support sled has dropped to its lower dispensing position, exposing a reserve roll.

Most preferably the support sled of the dispenser is configured such that it is generally symmetrical about an axis of rotation 138, shown on FIG. 6. This feature is important in commercial installations because it is preferred to leave a partially consumed roll on its spindle and replace only rolls that are substantially exhausted. Thus an attendant seeking to replenish the dispensers in a facility will simply remove the support sled from dispenser 10, move rail 34 to an open position and replace only the exhausted roll. The support sled is then rotated 180° and replaced in the dispenser such that the full roll is reserved in the upper dispensing position 150 as is shown in FIG. 1. It is thus not necessary to remove a partially depleted roll when replenishing the dispenser. When the roll is exhausted the latch dog assembly is biased inwardly by a leaf spring such as leaf spring 144 such that it moves to release position 76 upon exhaustion of the roll. The latch dog projection then moves inwardly as is shown in FIGS. 7 and 12 where latch dog projection 88 moves inwardly with respect to the support sled allowing it to travel to a lower dispensing position such as that seen in FIG. 13.

Figure 8:
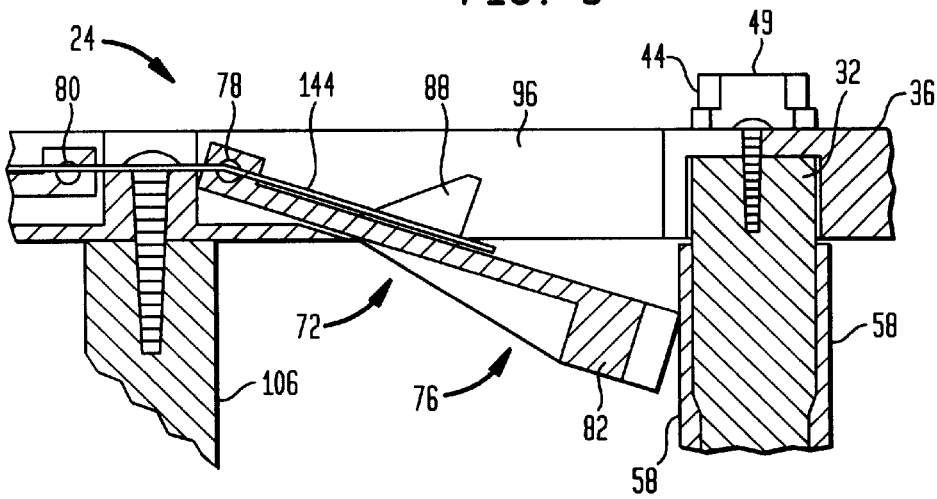
FIG. 8 is an enlarged partial top plan schematic view illustrating the gauge member of the latch dog assembly in its inner release position.

In a particularly preferred embodiment, the dispenser of the invention is used for sequentially dispensing coreless rolls of tissue. First, one secures a plurality of coreless tissue rolls including a reserve roll such as roll 56 about the spindles of the support sled. The support sled is then mounted in a dispenser housing which has a guide track such as a first guide track such as 20, of left sidewall 14, and a guide track 22 of right sidewall 16 such that the sled is mounted for generally vertical motion between an upper dispensing position such as position 150 and a lower dispensing position such as 152, the housing having an upper enclosure typically defined by a cover such as cover 12 for sequestering a reserved roll such as roll 56 in the upper dispensing position and being generally configured to expose the reserve roll for dispensing in the lower dispensing position such as position 152. The housing further includes in one of its guide tracks a latch means such as latch projection 26 including a locking shoulder 28. The support sled includes first and second spindles 30,32 adapted for receiving the rolls of coreless tissue. At least first and second frame rails support the spindles between the rails. The rails are further provided with guide surfaces such as guide surfaces 38 through 44 configured to cooperate with the guide tracks of the housing in which the support sled is mounted for guiding the support sled in generally vertical motion between an upper dispensing position and a lower dispensing position. At least one of the frame rails is moveable with respect to the first and second spindles of the support sled and includes a pair of retaining flanges such as flanges 52 and 54 for securing the rolls onto the support sled. The rolls are releasably secured about the first and second spindles of the support sled in retaining position 60 and maybe removed when the moveable frame rail is moved to an open position such as position 62. When a full roll is placed about a spindle, such as roll 56 shown in FIG. 7, and the left rail is in a closed or retaining position 60, the roll bears upon surface 85 of gauge member 84 and forces assembly 70 and latch dog projection 90 outwardly to the locking position as shown in FIG. 7, the left side. When a roll is depleted, such as depleted roll 58 shown on the right side of FIG. 7 and in FIG. 8, the associated latch dog assembly moves inwardly as shown in FIGS. 7 and 8 and as further noted above under the influence of spring 144.

At least one of the frame rails is provided with an inwardly biased latch dog assembly disposed adjacent at least one of the first and second spindles. Typically the inventive support sled contains two latch dogs which are inwardly biased by a single leaf spring. The latch dog assemblies are configured so that they are urged outwardly to a locking position upon disposing a roll of coreless tissue about its adjacent spindle and is biased inwardly to a release position 76 upon depletion of the roll of coreless tissue disposed about its adjacent spindle. That is to say, the latch dog assembly of the support sled is adapted to cooperate with the locking shoulder of the dispenser to retain the support sled in the upper dispensing position while urged outwardly to its locking position and to allow movement of the support sled to the lower dispensing position upon movement of the locking surface of the latch dog assembly to its inner release position, thereby exposing the reserve roll of coreless tissue for dispensing.

Figure 14:
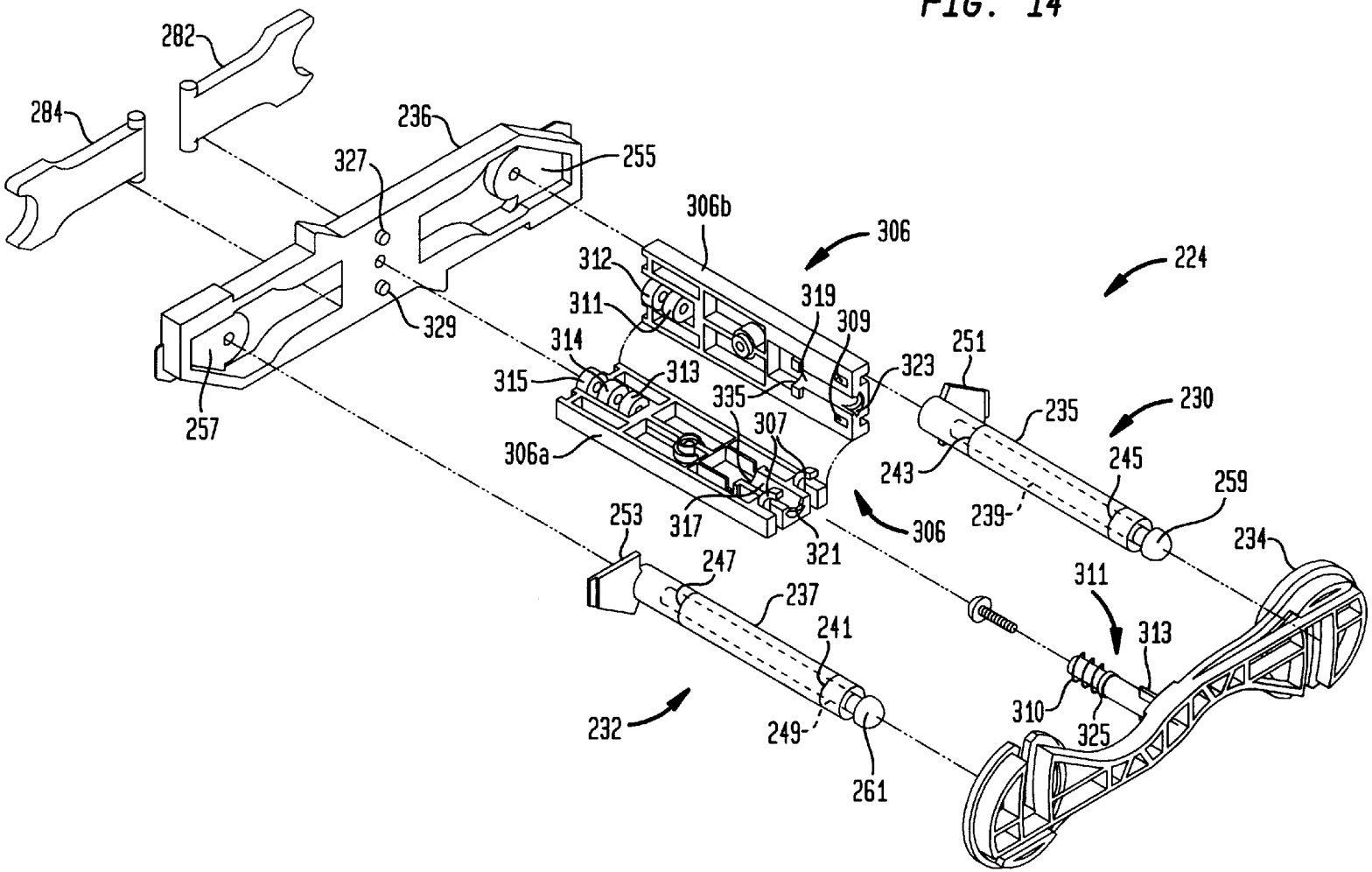
FIG. 14 is an exploded view showing an alternate embodiment of the invention wherein the spindles of the support sled have a rotatable sleeve about their central portions.

There is shown in FIG. 14 an alternate embodiment of the inventive support sled, wherein like parts are numbered 200 numerals higher than the above embodiment and the sled is shown in an exploded view. Support sled 224 includes a first spindle 230, a second spindle 232, a left frame rail 234, a right frame rail 236 provided with gauge members 282, 284 as was described above in connection with parts numbered 200 numerals lower. Further features included in the embodiment of FIG. 14 include rotatable central portions 235, 237 of spindles 230, 232. Portions 235 and 237 are in the form of sleeves mounted about a pair of central shafts 239, 241 indicated in dashed lines. The sleeves extend over most of the length of the spindles; more than about 75 percent of their length and have beveled ends indicated at 243, 245, 247 and 249 to ensure that the rotating central segments of the spindles do not snag the tissue. Without a rotating central portion, a roll of coreless tissues will tend to tighten up on the spindle and thus not dispense freely.

The spindles are further provided with feet 251, 253 adapted to fit into slots 255, 257 of frame rail 236 as well as slotted knobs 259, 261 adapted to cooperate with slotted rail 234.

Further refinements to the embodiment shown in FIG. 14 include a two-piece support bar 306 made up of a first part 306(*a*) and a second part 306(*b*) having retaining features such as hooks 307 and slots 309 as well as rings 311, 312, 313, 314 and 315 to secure the parts together.

Each part 306(*a*), 306(*b*) includes a hemicylindrical channel 317, 319 with relieved portions 321, 323 as shown. The parts are configured to cooperate so that they are assembled about a shaft 311 molded integrally with rail 234 which is also provided with an integrally-formed positioning bar 313. Spring 310 is positioned on shaft 311 between a movable ring 325 and a screw such that it urges rail 234 inwardly when the sled is assembled; that is, when bar 306 is assembled and positioned by way of molded-in pins 327, 329 and the other parts are secured in place, ring 325 fits in slot 335. Likewise, relieved portions 321, 323 of channels 317 and 319 cooperate with positioning bar 313 to force it outwardly when rail 234 is rotated to the open position. Note that portions 321, 323 have a maximum lateral projection in their intermediate portion so that the rotation of support rail 234 is bistable; that is, the rail is retained in either the fully open or fully closed position because of the shape of the relief portions in the respective channels.

While the invention has been described in detail with respect to preferred embodiments, modification to those embodiments within the spirit and scope of the present invention, set forth in the appended claims, will be readily apparent to those of skill in the art.

What is claimed is:

1. A roll support sled adapted to support a plurality of rolls of absorbent sheet for mounting in a dispenser of the class including a pair of vertically oriented guide tracks for guiding the roll support sled in vertical motion for sequential dispensing of the rolls, at least one of the guide tracks including latch means defining a locking shoulder, said roll support sled comprising:

(a) first and second spindles for receiving rolls of said absorbent sheet material;

(b) first and second frame rails for supporting said first and second spindles, said rails being provided with guide means configured to cooperate with the guide tracks of the dispenser in which the support sled is mounted for guiding the support sled in generally vertical motion between an upper dispensing position and a lower dispensing position, (i) at least one of said frame rails being moveable with respect to said first and second spindles of said support sled and further including a first retaining flange and a second retaining flange configured to releasably secure rolls of absorbent sheet material about said first and second spindles of said support sled in a retaining position and to allow positioning of rolls of absorbent sheet about said first and second spindles in an open position;

(ii) at least one of said frame rails being provided with an inwardly biased latch dog assembly disposed adjacent at least one of said first and second spindles;

(c) said latch dog assembly being configured so that it is urged outwardly to a locking position upon disposing a roll of absorbent sheet about its adjacent spindle and is biased inwardly to a release position upon depletion of the roll of absorbent sheet material disposed about its adjacent spindle, wherein the latch dog assembly of the support sled is adapted to cooperate with the locking shoulder of the guide track of the dispenser to retain the support sled in the upper dispensing position while urged outwardly to its locking position and allow movement of said support sled to the lower dispensing position upon movement of the latch dog assembly to its inner release position.

2. The roll support sled according to claim 1, wherein said inwardly biased latch dog assembly comprises a pivotally mounted gauge member adapted to engage the end of a roll of absorbent sheet material positioned about its adjacent spindle whereby the gauge member is urged outwardly into generally parallel alignment with said frame rail upon contact with said roll of absorbent sheet material such that the latch dog assembly is urged outwardly to its locking position, said gauge member having a terminal portion gapped with its adjacent spindle a predetermined distance in the locking position and being configured and biased to pivot inwardly so that the latch dog means assumes its release position upon depletion of the roll of absorbent sheet material mounted about its adjacent spindle.

3. The roll support sled according to claim 2, wherein said gauge member has mounted thereon a latch dog projection configured to engage the locking shoulder of the track means of the dispenser.

4. The roll support sled according to claim 2, wherein the terminal portion of the gauge member is generally arcuate in shape such that the gap between the gauge member and its adjacent spindle is of generally uniform width in the locking position.

5. The roll support sled according to claim 2, wherein said frame rail is provided with a longitudinal slot and said gauge member is pivotally mounted in said slot such that the frame rail and the gauge member form generally contiguous surfaces when the gauge member is urged into alignment with its frame rail.

6. The roll support sled according to claim 2, adapted to receive coreless tissue rolls.

7. The roll support sled according to claim 6, wherein the first and second spindles are rotatable about their central portions.

8. The roll support sled according to claim 1, further comprising a support bar located intermediate said first and second spindles and generally parallel thereto, wherein said moveable frame rail is rotatably secured to said support bar such that it can be rotated between its roll retaining position and its open position, and further wherein in its roll retaining position said moveable frame rail is generally parallel to the other frame rail.

9. The roll support sled according to claim 8, wherein said moveable frame rail is rotatably mounted for helical movement with respect to the other frame rail so that a normal distance between the frame rails will increase as the moveable frame rail is rotated from its roll retaining position to its open position.

10. The roll support sled according to claim 9, wherein said flanges of said moveable frame are slotted flanges and said first and second spindles of said roll support sled are provided with channels adapted to cooperate with said slotted flanges to lock said moveable frame rail in its roll retaining position.

11. The roll support sled according to claim 1, wherein said roll support sled is a reversible roll support sled with a first and second latch dog assembly on one of its frame rails, generally rotationally symmetrical about an axis of rotation such that the sled may be removed from a dispenser and rotated 180° about said axis of rotation and replaced in the dispenser to operate in a substantially identical manner as before rotation.

12. The roll support sled according to claim 11, wherein said first and second latch dog assemblies are biased inwardly by a single leaf spring.

13. A latch dog assembly for mounting on a frame rail of a roll support sled for use in a dispenser of the class adapted to sequentially dispense rolls of absorbent sheet, said latch dog assembly being adapted to move between an inner release position and an outer locking position with respect to said rail and to be mounted adjacent a roll receiving spindle of said roll support sled, said latch dog assembly comprising:

(a) biasing means for urging said latch dog means to its inner release position and (b) a pivotally mounted gauge member adapted to engage the end of a roll of absorbent sheet material positioned about its adjacent spindle whereby the gauge member is urged outwardly into generally parallel alignment with said frame rail upon contact with said roll of absorbent sheet material such that the latch dog assembly is urged outwardly to a locking position, said gauge member having a terminal portion gapped with its adjacent spindle a predetermined distance in the locking position and being configured and biased to pivot inwardly to a release position so that the latch dog assembly assumes its release position upon depletion of the roll of absorbent sheet material mounted about its adjacent spindle.

14. The latch dog assembly according to claim 13, wherein said gauge member has mounted thereon a latch dog projection configured to engage a locking shoulder of said dispenser.

15. The latch dog assembly according to claim 13, wherein the terminal portion of the gauge member is generally arcuate in shape such that the gap between the gauge member and its adjacent spindle is of generally uniform width in its locking position.

16. The latch dog assembly according to claim 13, wherein said frame rail is provided with a longitudinal slot and said gauge member is pivotally mounted in said slot such that the frame rail and the gauge member form generally contiguous surfaces when the gauge member is urged into alignment with its frame rail.

17. The latch dog assembly according to claim 13, adapted to cooperate with coreless tissue rolls for movement between its outer locking position and its inner release position.

18. A roll dispenser for sequentially dispensing rolls of absorbent sheet material comprising a housing and a support sled moveable between an upper dispensing position and a lower dispensing position within said housing;

(a) said housing defining an upper enclosure and including a first supporting sidewall and a second supporting sidewall;

(i) said upper enclosure being configured to sequester at least one reserve roll of said absorbent sheet material from exposure for dispensing in said upper dispensing position;

(ii) said first supporting sidewall being provided with a first guide track;

(iii) said second supporting sidewall being provided with a second guide track as well as with latch means defining a locking shoulder;

(b) a roll support sled configured to receive a plurality of rolls absorbent sheet material and configured for slidably mounting in said first and second guide tracks of said first and second support sidewalls respectively of said housing, the support sled including at least first and second spindles for receiving rolls of said absorbent sheet as well as first and second frame rails for supporting said first and second spindles, said support sled including first guide means configured to cooperate with said first guide track of said first supporting sidewall of said housing to guide said support sled in generally vertical motion with respect to said first and second supporting sidewalls of said housing for movement between said upper dispensing position and said lower dispensing position and further including second guide means configured to cooperate with said second guide track of said second supporting sidewall of said housing to guide said support sled in generally vertical motion with respect to said first and second supporting sidewalls of said housing for movement between said upper dispensing position and said lower dispensing position;

(i) at least one of said frame rails being moveable with respect to said first and second spindles of said support sled and further including a first retaining flange and a second retaining flange configured to releasably secure rolls of absorbent sheet about said first and second spindles of said support sled in a retaining position and to allow positioning of rolls of absorbent sheet material about said first and second spindles of said support sled in an open position;

(ii) at least one of said frame rails being provided with an inwardly biased latch dog assembly disposed adjacent at least one of said first and second spindles, said latch dog assembly being configured so that it is urged outwardly to a locking position upon disposing a roll of absorbent sheet material about its adjacent spindle and said latch dog assembly is biased inwardly to a release position upon depletion of said roll of absorbent sheet disposed about its adjacent spindle;

wherein said second guide track along with the locking shoulder of its latch means and the latch dog assembly of the support sled are configured and arranged so that upon mounting of said support sled in said guide tracks of said supporting walls of said housing the locking shoulder of the second guide track cooperates with the latch dog assembly of said support sled in the locking position to retain said support sled in said upper dispensing position and allow movement of said support sled to said lower dispensing position upon movement of the latch dog assembly to its release position so as to expose a reserve roll of absorbent sheet for dispensing.

19. The dispenser according to claim 18, wherein said inwardly biased latch dog assembly comprises a pivotally mounted gauge member adapted to engage the end of the roll of absorbent sheet material positioned about its adjacent spindle whereby the gauge member is urged outwardly into generally parallel alignment with said frame rail upon contact with said roll of absorbent sheet material such that the latch dog assembly is urged outwardly to its locking position, said gauge member having a terminal portion gapped with its adjacent spindle a predetermined distance in the locking position and being configured and biased to pivot inwardly so that the latch dog means assumes its release position upon depletion of the roll of absorbent sheet material mounted about its adjacent spindle.

20. The dispenser according to claim 19, wherein said gauge member has mounted thereon a latch dog projection configured to engage the locking shoulder of the track means of the dispenser.

21. The dispenser according to claim 19, wherein the terminal portion of the gauge member is generally arcuate in shape such that the gap between the gauge member and its adjacent spindle is of general uniform width in the locking position of said latch dog assembly.

22. The dispenser according to claim 19, wherein the frame rail carrying the latch dog assembly is provided with a longitudinal slot and the gauge member is pivotally mounted in the slot such that the frame rail and the gauge member form generally contiguous surfaces when the gauge member is urged into alignment with its frame rail.

23. The dispenser according to claim 19, adapted to receive coreless tissue rolls.

24. The roll support sled according to claim 23, wherein the first and second spindles are rotatable about their central portions.

25. The dispenser according to claim 19, wherein the support sled further comprises a support bar located intermediate said first and second spindles and generally parallel thereto, wherein said moveable frame rail is rotatably secured to said support bar such that it can be rotated between its roll retaining position and its open position, and further wherein in its roll retaining position said moveable frame rail is generally parallel to the other frame rail.

26. The dispenser according to claim 25, wherein the moveable frame rail of said roll support sled is rotatably mounted for helical motion with respect to the other frame rail so that a normal distance between the frame rails will increase as the moveable frame rail is rotated from its roll retaining position to its open position.

27. The dispenser according to claim 26, wherein the flanges of the moveable frame of the support sled are slotted flanges and the first and second spindles of the roll support sled are provided with channels adapted to cooperate with the slotted flanges to lock said moveable frame rail in its roll retaining position.

28. The dispenser according to claim 18, wherein said roll support sled is a reversible roll support sled with a first and second latch dog assembly on one of its frame rails, generally rotationally symmetrical about an axis of rotation such that the sled may be removed from the dispenser and rotated 180° about the axis of rotation and replaced in the dispenser to operate in a substantially identical manner as before rotation thereof.

29. A method for sequentially dispensing coreless rolls of tissue comprising:

(a) securing a plurality of coreless tissue rolls including a reserve roll about the spindles of a support sled; and (b) mounting said support sled in a dispenser housing of the class including a pair of guide tracks for guiding the support sled in generally vertical motion between an upper dispensing position and a lower dispensing position, said housing defining an upper enclosure for sequestering a reserve roll from dispensing in said upper dispensing position and being generally configured to expose the reserve roll for dispensing in said lower dispensing position, said housing further including on one of its guide tracks latch means defining a locking shoulder, wherein support sled includes:

(i) at least first and second spindles adapted for receiving the rolls of coreless tissue, (ii) at least first and second frame rails for supporting said first and second spindles, said rails being provided with guide means configured to cooperate with the guide tracks of the housing in which the support sled is mounted for guiding the support sled in generally vertical motion between said upper dispensing position and said lower dispensing position;

(iii) at least one of said frame rails being moveable with respect to said first and second spindles of said support sled and further including a first retaining flange and a second retaining flange configured to releasably secure the rolls of coreless tissue about the first and second spindles of the support sled in a retaining position and to allow positioning of rolls of coreless tissue about the first and second spindles in an open position;

(iv) at least one of said frame rails being provided with an inwardly biased latch dog assembly disposed adjacent at least one of said first and second spindles;

said latch dog assembly being configured so that it is urged outwardly to a locking position upon disposing a roll of coreless tissue about its adjacent spindle and is biased inwardly to a release position upon depletion of the roll of coreless tissue disposed about its adjacent spindle, wherein the latch dog assembly of the support sled is adapted to cooperate with the locking shoulder of the dispenser to retain the support sled in the upper dispensing position while urged outwardly to its locking position and to allow movement of the support sled to the lower dispensing position upon movement of the locking surface of the latch dog assembly to its inner release position, thereby exposing the reserve roll of coreless tissue for dispensing.

30. The method according to claim 29, wherein the latch dog assembly comprises a pivotally mounted gauge member adapted to engage the end of a coreless roll of tissue positioned about its adjacent spindle whereby the gauge member is urged outwardly into generally parallel alignment with its frame rail upon contact with said roll of coreless tissue such that the latch dog assembly is urged outwardly to its locking position, said gauge member having a terminal portion gapped with its adjacent spindle a predetermined distance in the locking position and being biased to pivot inwardly so that the latch dog assembly assumes it release position upon depletion of the roll of coreless tissue mounted about its adjacent spindle.

31. The method according to claim 30, wherein the first and second spindles are rotatable about their central portions.

32. The method according to claim 30, wherein the gauge member has mounted thereon a latch dog projection configured to engage the locking shoulder of the track means of the dispenser.

33. The method according to claim 30, wherein the terminal portion of the gauge member of the latch dog assembly is generally arcuate in shape such that the gap between the gauge member and its adjacent spindle is of generally uniform width in its locking position.

34. The method according to claim 30, wherein the frame rail upon which the latch dog assembly is mounted is provided with a longitudinal slot and said gauge member of said latch dog assembly is pivotally mounted in the slot such that the frame rail and the gauge member form generally contiguous surfaces when the gauge member is urged into alignment with its frame rail.

35. The method according to claim 29, wherein the roll support sled further comprises a support bar located intermediate said first and second spindles and is generally parallel thereto, wherein the moveable frame rail is rotatably secured to the support bar such that it can be rotated between its roll retaining position and its open position, and further wherein in its roll retaining position said moveable frame rail is generally parallel to the other frame rail.

36. The method according to claim 35, wherein the moveable frame rail of the support sled is rotatably mounted upon said support bar so that a normal distance between the frame rails will increase as the moveable frame rail is rotated from its roll retaining position to its open position.

37. The method according to claim 36, wherein the flanges of the moveable frame rail of the support sled are slotted flanges and said first and second spindles of said roll support sled are provided with channels adapted to cooperate with said slotted flanges to lock said moveable frame rail in its roll retaining position.

38. The method according to claim 29, wherein said roll support sled is a reversible roll support sled with a first and second latch dog assembly on one of its frame rails generally rotationally symmetrical about an axis of rotation such that the sled may be removed from the dispenser and rotated 180° about its axis of rotation and replaced in the dispenser to operate in a substantially identical manner as before rotation.

39. The method according to claim 38, wherein the first and second latch dog assemblies are biased inwardly by a single leaf spring.

* * * * *

UNITED STATES PATENT AND TRADEMARK OFFICE

CERTIFICATE OF CORRECTION

PATENT NO. : 6,752,349 B2
DATED : June 22, 2004
INVENTOR(S) : John R. Moody et al.

It is certified that error appears in the above-identified patent and that said Letters Patent is hereby corrected as shown below:

Column 4,
Line 40, delete “;” and insert -- : -- ;

Column 6,
Line 13, delete “showing” and insert --shown --;

Column 8,
Line 1, delete “maybe” and insert --may be --;
Line 42, delete “;” and insert -- , --;

Column 11,
Line 47, insert -- of -- after “rolls”;

Column 12,
Line 53, delete “general” and insert -- generally --;

Column 13,
Line 40, delete “,” and insert -- ; --; and

Column 14,
Line 17, delete “it” and insert -- its --.

Signed and Sealed this

Ninth Day of November, 2004

JON W. DUDAS
*Director of the United States Patent and Trademark Office*